US006691411B2

(12) United States Patent
Ball

(10) Patent No.: US 6,691,411 B2
(45) Date of Patent: Feb. 17, 2004

(54) METHOD OF INSTALLING A WASTEWATER DRAIN ASSEMBLY FOR A BATHTUB

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 09/954,420

(22) Filed: Sep. 17, 2001

(65) Prior Publication Data

US 2003/0051343 A1 Mar. 20, 2003

(51) Int. Cl.[7] ..... B21D 51/16
(52) U.S. Cl. ..... 29/890.141; 4/684; 4/293
(58) Field of Search ..... 29/890.14, 890.141, 29/890.09, 890.144, 890.149; 4/683, 684, 286, 295, 293

(56) References Cited

U.S. PATENT DOCUMENTS

| | | | | | |
|---|---|---|---|---|---|
| 1,925,008 | A | * | 8/1933 | Schacht | 4/293 |
| 2,044,253 | A | * | 6/1936 | Morris | 4/683 |
| 3,937,497 | A | * | 2/1976 | Studer | 285/111 |
| D248,133 | S | * | 6/1978 | Shames et al. | D6/86 |
| 4,146,939 | A | * | 4/1979 | Izzi | 4/286 |
| 4,233,697 | A | * | 11/1980 | Cornwall | 4/293 |
| 4,352,213 | A | * | 10/1982 | Watts | 4/199 |
| 4,825,477 | A | * | 5/1989 | Aranda | 4/286 |
| 4,920,582 | A | * | 5/1990 | Alker | 4/198 |
| 5,377,361 | A | * | 1/1995 | Piskula | 4/252.4 |
| 5,507,501 | A | * | 4/1996 | Palmer | 277/9 |
| 5,692,248 | A | | 12/1997 | Ball | |
| 5,745,931 | A | * | 5/1998 | Ball | 4/286 |
| 5,890,241 | A | * | 4/1999 | Ball | 4/538 |
| 5,957,514 | A | * | 9/1999 | Brookshire | 294/19.1 |
| 6,058,526 | A | * | 5/2000 | Parisi et al. | 4/688 |
| 6,085,363 | A | * | 7/2000 | Huber | 4/252.4 |
| 6,088,843 | A | * | 7/2000 | Francisco | 4/289 |
| 6,145,136 | A | * | 11/2000 | Parisi et al. | 4/291 |
| 6,263,518 | B1 | * | 7/2001 | Magtanong | |
| 6,295,664 | B2 | * | 10/2001 | Fritz et al. | 4/679 |
| 6,338,168 | B1 | * | 1/2002 | Valentine | 4/293 |
| 6,530,722 | B1 | * | 3/2003 | Shaw et al. | 4/293 |
| 2001/0002494 | A1 | * | 6/2001 | Fritz et al. | 4/679 |
| 2002/0032926 | A1 | * | 3/2002 | Lewis | 4/680 |
| 2002/0112285 | A1 | * | 8/2002 | Minnick | 4/694 |

* cited by examiner

*Primary Examiner*—Gregory Vidovich
*Assistant Examiner*—Marc Jiminez

(57) ABSTRACT

A method of installing a wastewater drain assembly for a bathtub by inserting an L-shaped drain pipe into a drain hole of a bathtub such that an annular flange on the drain pipe rests on a bottom wall of the bathtub. Slideably mounting a lock washer over the drain pipe and threadably tightening the lock washer against a lower surface of the bottom wall of a bathtub. Connecting the drain pipe to a drain system. Testing the drain assembly for water leaks. Finally, installing a drain closure into the upper end of the drain pipe.

8 Claims, 2 Drawing Sheets

METHOD OF INSTALLING A WASTEWATER DRAIN ASSEMBLY FOR A BATHTUB

BACKGROUND OF THE INVENTION

The traditional method of installing a wastewater drain assembly for a bathtub is well established, and generally, is considered a two-person job. Not only is the process somewhat cumbersome and difficult, requiring pieces to be held in place while assembled, but it also creates obstacles to field testing the drain assemblies for leaks where testing is required. Likewise, the traditional method requires the removal of a strainer body in order to replace finished materials. Therefore, a need exists for an easier method to install a drain assembly that can be accomplished by a single individual. In addition, a need also exists for a method that accomodates ease of field testing, ease in replacing finished parts, and reduction in the amount of material that requires special finishing.

BRIEF SUMMARY OF THE INVENTION

The primary object of the invention is to provide a method of installing a drain assembly that can be accomplished by a single individual. A further object of the invention is to provide a method of installing a drain assembly that is easy to install and allows for ease in field testing for leaks. Another objective of the present invention is to provide a method of installing a drain assembly that eliminates the need for the removal of the strainer body in order to replace finished parts. A still further object of the present invention is to provide a method that reduces the number of parts that require special finishing.

In accordance with the above objectives, the method of the present invention includes the steps of inserting an L-shaped drain pipe having an upper end with an annular flange covered by a membrane, an inner end, and a threaded portion near the upper end, through a drain hole of a bathtub, such that the annular flange rests on a bottom wall of the bathtub. Next, a lock washer is slidably mounted over the inner end of the drain pipe to the threaded portion, and then is threadably tightened against a lower surface of the bottom wall of the bathtub. The outer end of the L-shaped drain pipe is then connected to the drain system of the building. The assembly is then tested for water leaks. Once determined that there are no leaks, the membrane is removed from the flange on the upper end of the drain pipe. Finally, a finished cover is installed on the annular flange.

These and other objectives, features, and advantages of the present invention will become apparent to one skilled in the art upon reading the following detailed description in view of the drawings.

DETAILED DESCRIPTION OF THE INVENTION

Figure 1:
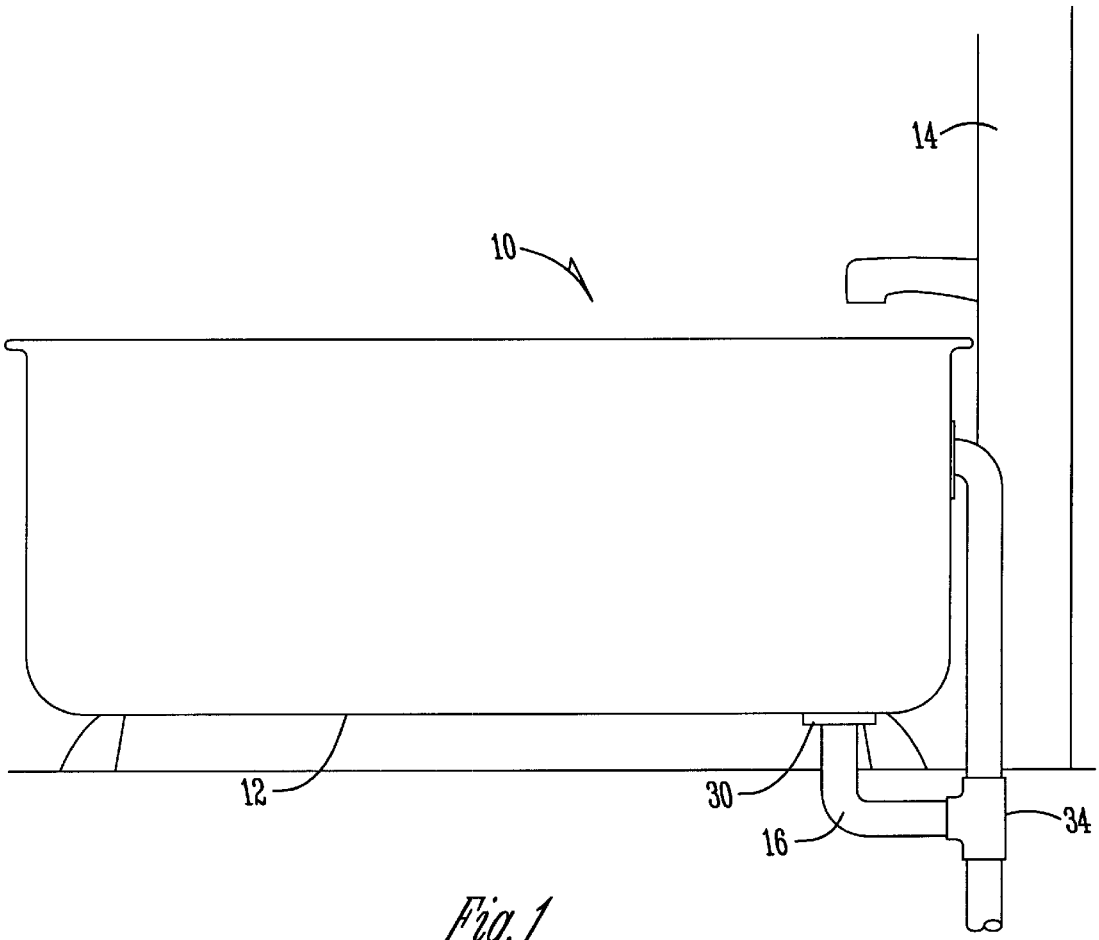
FIG. 1 is a side view of the drain assembly installed in a bathtub.
Figure 2:
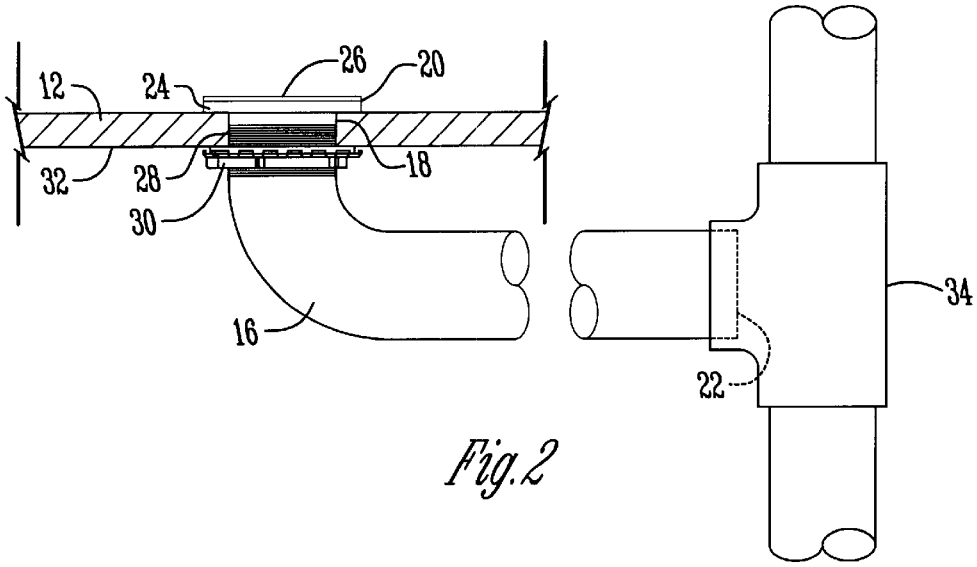
FIG. 2 is a side view of the installed drain assembly.
Figure 3:
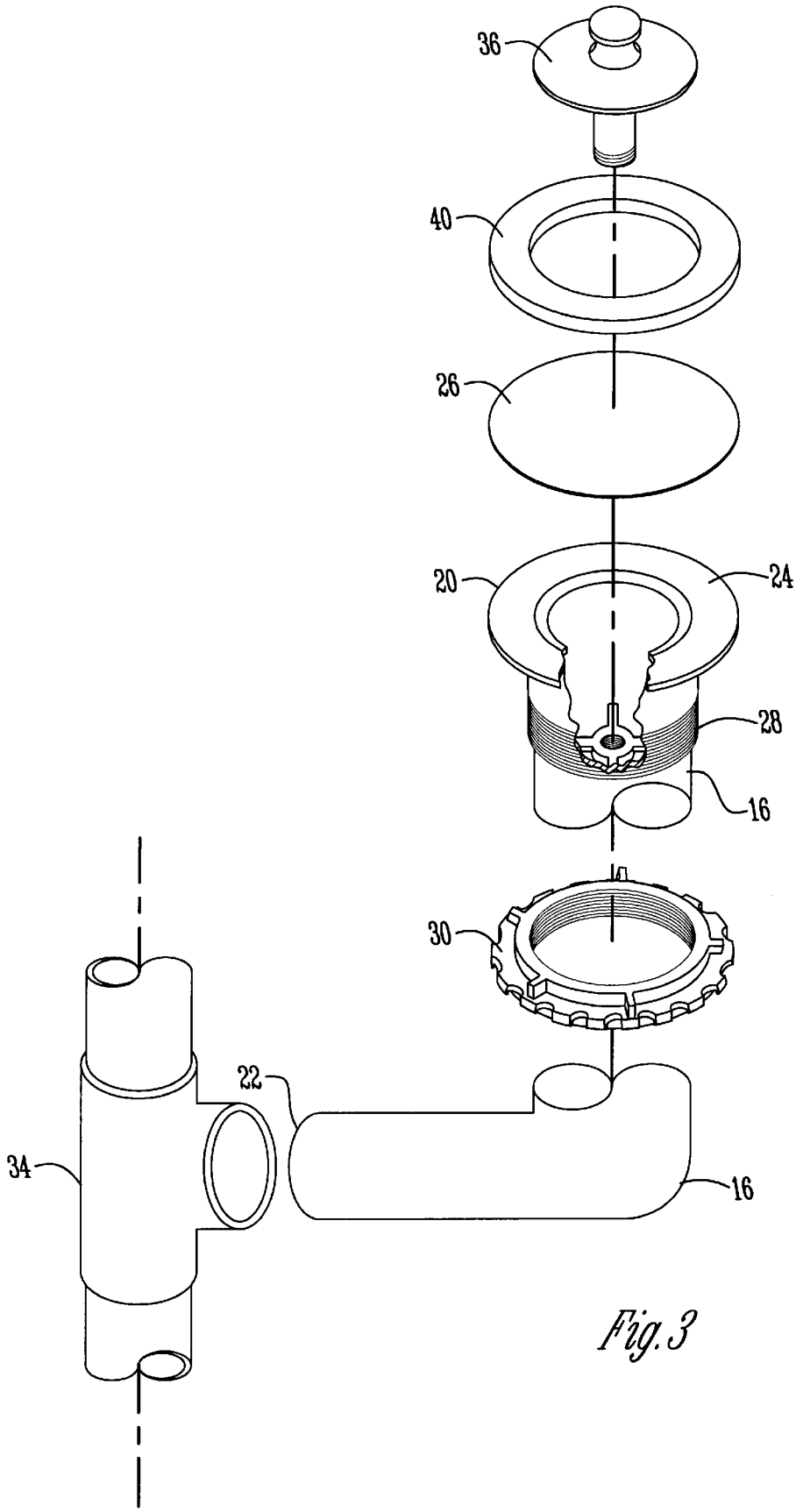
FIG. 3 is an exploded perspective view of the drain assembly.

Referring now to FIG. 1, therein is shown a bathtub 10 with a bottom wall 12. The method of the present invention applies predominantly to new construction, where the tub is in place, and no drywall has been applied to the open interior wall 14. The method begins by inserting a generally L-shaped drain pipe 16 through a drain hole 18 on the bottom wall 12 of the bathtub 10. The drain pipe 16 has both an upper end 20 and an inner end 22. The upper end terminates in an annular flange 24 and in one embodiment is covered by a membrane 26. Also, near the upper end 20 of the drain pipe 16 is a threaded portion 28. The drain pipe 16 is inserted into the drain hole 18, such that the annular flange 24 rests on the bottom wall 12 of the bathtub 10. A sealant material is placed on a lower surface of the annular flange 24 for securing the annual flange to the bottom wall 12 of the bathtub 10.

Next, a lock washer 30 is slidably mounted over the inner end 22 of the drain pipe 16 until it reaches the threaded portion 28 near the upper end 20 of the drain pipe 16. There, lock washer 30, which is threadably received on the threaded portion 28, is tightened against the lower surface 32 of the bottom wall 12 of the bathtub 10.

Once the lock washer 30 is tightened, the inner end 22 of the drain pipe 16 is connected to a drain system 34. Once connected, the drain assembly and drain system are tested for water leaks. When it is determined that there are no leaks, the membrane 26 is removed from the flange 24 on the upper end 20 of the drain pipe 16.

Once the drain closure 36 is installed, a cover 40 can be placed on the flange 24 of the upper end 22 of the drain pipe 16. In the preferred embodiment, the cover 40 frictionally engages the flange 24.

Then, a drain closure 36 is installed into the upper end 20 of the drain pipe 16. The drain closure 36 can be of any conventional type, including lift and turn, foot actuated, or PUSH-PULL™ closures. Likewise, a PRESFLO™ drain closure such as the one described in U.S. Pat. No. 4,457,030 by Burry can be installed. Crossbars 38 can be snapped into the upper end 20 of the drain pipe 26 to assist in securing the drain closure 36 depending upon the type of drain closure used. The ability to snap in the crossbars 38 minimizes the difficulty in repairing stripped out threads used in some conventional drain closures.

Because the drain assembly is installed with new construction where the tub is in place and there is no drywall on the open interior wall 14, a single individual is capable of holding the drain pipe 16 in place while the lock washer is slidably mounted on the drain pipe and tightened on the threaded portion 28, thus eliminating the need for multiple individuals for installation. As can be seen from the foregoing disclosure, the present invention provides an easy method of installing a drain assembly for a bathtub by a single individual that makes it easier to test for leaks, easier to replace the finished materials without requiring the removal of the strainer body, and reduces the amount of material that requires special finishing. Having described the preferred embodiment, it will become apparent that various modifications can be made without departing from the scope of the invention, as defined in the accompanying claims.

What is claimed is:

1. A method of installing a wastewater drain assembly for a bathtub, comprising:

inserting a generally L-shaped drain pipe having an upper end with an annular flange, a non-threaded inner end, and a threaded portion near the upper end through a drain hole of a bathtub, such that the annular flange, covered by a flat planar membrane of continuous construction that dwells in a single plane, rests on the bottom wall of the bathtub;

slideably mounting a lock washer over the inner end of the drain pipe to the threaded portion and threadably tightening the lock washer against a lower surface of the bottom wall of the bathtub;

connecting the inner end of the L-shaped drain pipe to a drain system;

testing the drain assembly for water leaks;

removing the membrane from the flange of the upper end of the drain pipe; and installing a drain closure into the upper end of the drain pipe.

2. The method of claim 1 further comprising the step of installing a cover on the flange of the upper end of the drain pipe.

3. The method of claim 1 further comprising the step of placing a sealant material on the annular flange for sealing the annular flange to the bottom wall of the bathtub.

4. A method of installing a wastewater drain assembly for a bathtub, comprising:

inserting a generally L-shaped drain pipe having an upper end with an annular flange, a non-threaded inner end, and a threaded portion near the upper end through a drain hole of a bathtub, such that the annular flange, covered by a flat planar membrane of continuous construction that dwells in a single plane, rests on the bottom wall of the bathtub;

slideably mounting a lock washer over the inner end of the drain pipe to the threaded portion and threadably tightening the lock washer against a lower surface of the bottom wall of the bathtub;

connecting the inner end of the L-shaped drain pipe to a drain system;

testing the drain assembly for water leaks;

removing the membrane from the flange of the upper end of the drain pipe;

installing a cover on the flange of the upper end of the drain; and installing a drain closure into the upper end of the drain pipe.

5. The method of claim 4 further comprising the step of placing a sealant material on the annular flange for sealing the annular flange to the bottom wall of the bathtub.

6. A method of installing a wastewater drain assembly for a bath tub comprising:

providing a generally L-shaped drain pipe having a hollow upstanding portion with an open upper end and a horizontal portion with an open inner end with the upstanding and horizontal portions being connected by an L-shaped portion;

placing a horizontal flange around the upper end of the upstanding portion;

providing external threads on an outside surface of the upstanding portion;

inserting the open inner end of the horizontal portion downwardly through a drain opening in a tub which has a diameter greater than a diameter of the upstanding portion but less than a diameter of the flange so that the flange engages a portion of the bathtub around the drain opening;

inserting a threaded lock washer with an internally threaded center bore over the inner end of the horizontal portion wherein the center bore of the lock washer has a diameter greater than an outside diameter of the horizontal portion, the L-shaped portion and the upstanding portion;

sliding the lock washer over the L-shaped drain pipe until it engages the external threads on the upstanding portion;

tightening the lock washer against a portion of the tub around and underneath the drain opening in the tub to seal the flange tightly against the tub around the drain opening; and connecting the open inner end of the horizontal portion to a waste water drain pipe.

7. The method of claim 6 further comprising the step of installing a cover on the flange of the upper end of the drain pipe.

8. The method of claim 6 further comprising the step of placing a sealant material on the annular flange for sealing the annular flange to the bottom wall of the bathtub.

* * * * *